US007073563B2

(12) United States Patent
Heggset

(10) Patent No.: US 7,073,563 B2
(45) Date of Patent: Jul. 11, 2006

(54) MACHINE FOR VERTICAL CASTING OF METAL

(75) Inventor: Bjarne A. Heggset, Kristiansund N (NO)

(73) Assignee: Heggset Engineering A.S., Kristiansund N (DK)

( * ) Notice: Subject to any disclaimer, the term of this patent is extended or adjusted under 35 U.S.C. 154(b) by 0 days.

(21) Appl. No.: 11/080,347

(22) Filed: Mar. 15, 2005

(65) Prior Publication Data

US 2005/0211410 A1 Sep. 29, 2005

(30) Foreign Application Priority Data

Mar. 16, 2004 (NO) ..... 20041096

(51) Int. Cl.
*B22D 11/00* (2006.01)

(52) U.S. Cl. ..... 164/416; 164/418; 164/443

(58) Field of Classification Search ..... 164/342, 164/418, 478, 416, 459, 443, 485
See application file for complete search history.

(56) References Cited

U.S. PATENT DOCUMENTS 6,167,940 B1 * 1/2001 Lonardi et al. ..... 164/416
6,609,557 B1 * 8/2003 Anderson ..... 164/459

* cited by examiner

*Primary Examiner*—Kevin Kerns
*Assistant Examiner*—I.-H. Lin
(74) *Attorney, Agent, or Firm*—Osha Liang L.L.P.

(57) ABSTRACT

A machine for vertical casting of metal, including a frame on which casting molds can be mounted and through which cooling water can be supplied during casting. The frame includes a horizontal cantilever arm protruding from a support and being journalled in the support with one end, for vertical pivoting of the frame, said support being rotatable about a vertical axis for horizontal pivoting of the frame.

4 Claims, 7 Drawing Sheets

MACHINE FOR VERTICAL CASTING OF METAL

BACKGROUND OF THE INVENTION

The present invention relates to a machine for vertical casting of metal, comprising a frame on which casting molds can be mounted and through which cooling water can be supplied during casting.

PRIOR ART

Machines of this kind usually comprise a rectangular frame. During casting the frame of the machine is horisontal. The frame can be pivoted up to a vertical position, in order to expose the cast items, such as bolts, for their removal. For this purpose the frame may be pivotably journalled at each end of one side of the frame.

The casting is carried out by supplying liquid metal to the casting molds on the frame. Simultaneously, cooling water is supplied for rapid cooling of the metal coming vertically down from the casting molds. The bolts are resting on a vertically movable table which is lowered during the casting. In this manner bolts having lengths of several meters can be cast.

An example of this casting technology is disclosed in U.S. Pat. No. 3,780,789.

Reference is also made to U.S. Pat. No. 5,323,841, disclosing a casting device having a frame which can be pivoted up to a vertical position and has a cooling jacket for cooling of the cast items, and reference is made to an article by Ed Nussbaum in LIGHT METAL AGE, August 1991, pages 18 and 19, "State-of-the-Art Billet Casting Operation at Aluminum Shapes", disclosing a casting machine having a frame which upon casting can be travelled away from the casting area and pivoted up to a nearly vertical position.

Machines for vertical casting of aluminum bolts and rolling ingots have been used for more than 50 years. However, a rather modest technological development has taken place in this field during the last 30 years as far the machines are concerned. The development has mainly been related to the size (the number of cast bolts/rolling ingots) and the degree of automation of the casting process.

Thus, the technological development as regards the casting machines has been very small compared with the results achieved by the development of the mold technology.

The general demands regarding the frame of the casting machine are among else:

A stable and repeatable positioning.

Movable mold "package" for removal of cast bolts/ingots.

Easy access for maintenance of casting molds.

Integrated supply of cooling water.

Orderly arrangement with good accessibility for cleaning.

No spill of water on floor or components.

SUMMARY OF THE INVENTION

The Present Invention

The present invention relates to a machine as defined introductorily, and wherein the frame comprises a horisontal cantilever arm protruding from a support and being journalled in the support with one end, for vertical pivoting of the frame, said support being rotatable about a vertical axis for horisontal pivoting of the frame.

Thus, the machine comprises a frame protruding from a support and being adapted for pivoting horisontally and vertically. The support is journalled in the base for pivoting about a vertical axis, and the support pivots together with the remainder of the frame during horisontal pivoting. One side of the frame constitutes a cantilever arm journalled in the support for pivoting about its own axis, for pivoting the frame up and down. Thereby, the casting molds fastened to the frame can be pivoted up after the casting and be pivoted in the horisontal plane (for instance 90 degrees), whereby the molds are accessible for maintenance and preparation for the next casting in a safe distance from the casting area and the area where the bolts are removed from the casting area.

Particularly sturdy bearings having a large inner diameter may be used for the cantilever arm and the support, in order to achieve a stiff structure which permits supply of-large amounts of cooling water by means of preferably stainless swivels having sealing rings. Supply of water through swivels is an advantage compared with supply through a conduit which has to be disconnected for movement of the frame.

Pivoting of the support may be accomplished by use of one or more worm screws engaging an external bearing ring formed as a worm gear. Pivoting of the cantilever arm and the frame may be accomplished by use of two hydraulic cylinders which form a force couple for counteracting the large moment of force caused by the weight of the frame and the molds carried by the frame. However, one or more worm screws and a worm gear may be used also for pivoting of the frame and the cantilever arm, in particular when the frame and the molds have a relatively light weight.

All components coming into contact with water should be made of stainless steel or be hot galvanized.

The most important advantages of the technology are:

A compact structure having a small number of components.

A stable structure.

Simple positioning.

Simple supply of cooling water.

Good accessibility for maintenance and repair of molds.

BRIEF DESCRIPTION OF THE DRAWINGS

Description of an Embodiment of the Invention

The invention will in the following be explained more detailed by means of examples, shown in the accompanying drawings.

DETAILED DESCRIPTION

Figure 1:
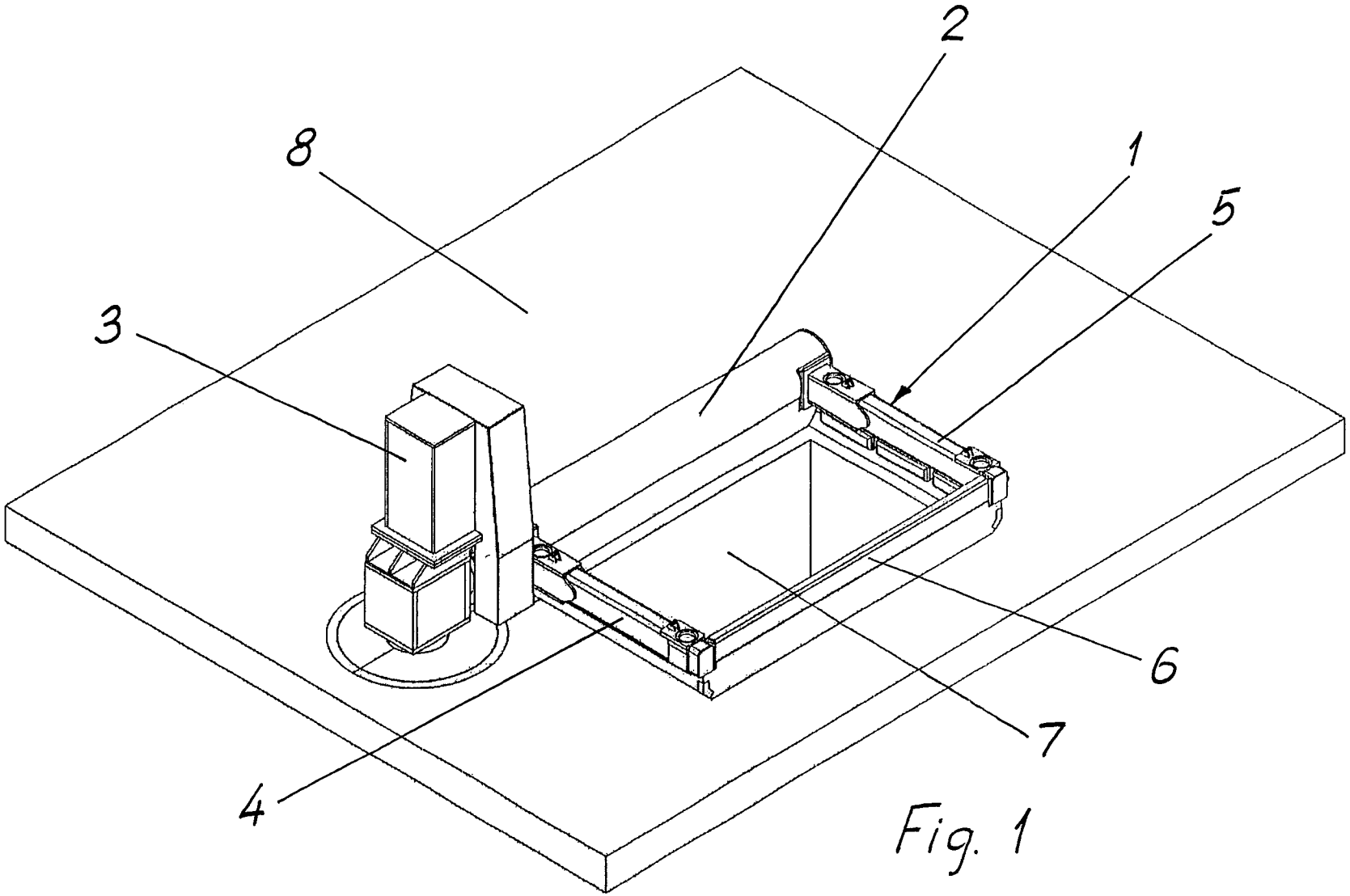
FIG. 1 shows the frame in a position above a pit. The casting molds will be mounted on the frame.

FIG. 1 shows a machine having a rectangular frame 1. One side of the frame forms a horisontal cantilever arm 2. One end of the arm 2 is pivotably journalled in a support 3 standing on a base 8 and pivotable about a vertical axis. Two parallel sides 4 and 5 of the frame protrude perpendicularly from the cantilever arm 2, and the distal ends of the sides are attached to a third side 6. Thus, the entire frame is carried by the support 3. FIG. 1 shows the frame 1 in the use position. During use casting molds (not shown) are mounted on the frame 1. In this position the frame 1 surrounds a pit 7 in which the casting is carried out. A table (not shown) which can be raised and lowered is situated in the pit 7. The table is lowered as vertical bolts are being cast and extended down into the pit 7 during the casting. Cooling water is continuosly supplied to the molds during the casting. The molds may be short sleeves having a substantially smaller length than the bolts, because the metal in the bolts will solidify almost immediately upon emerging from the molds.

Figure 2:
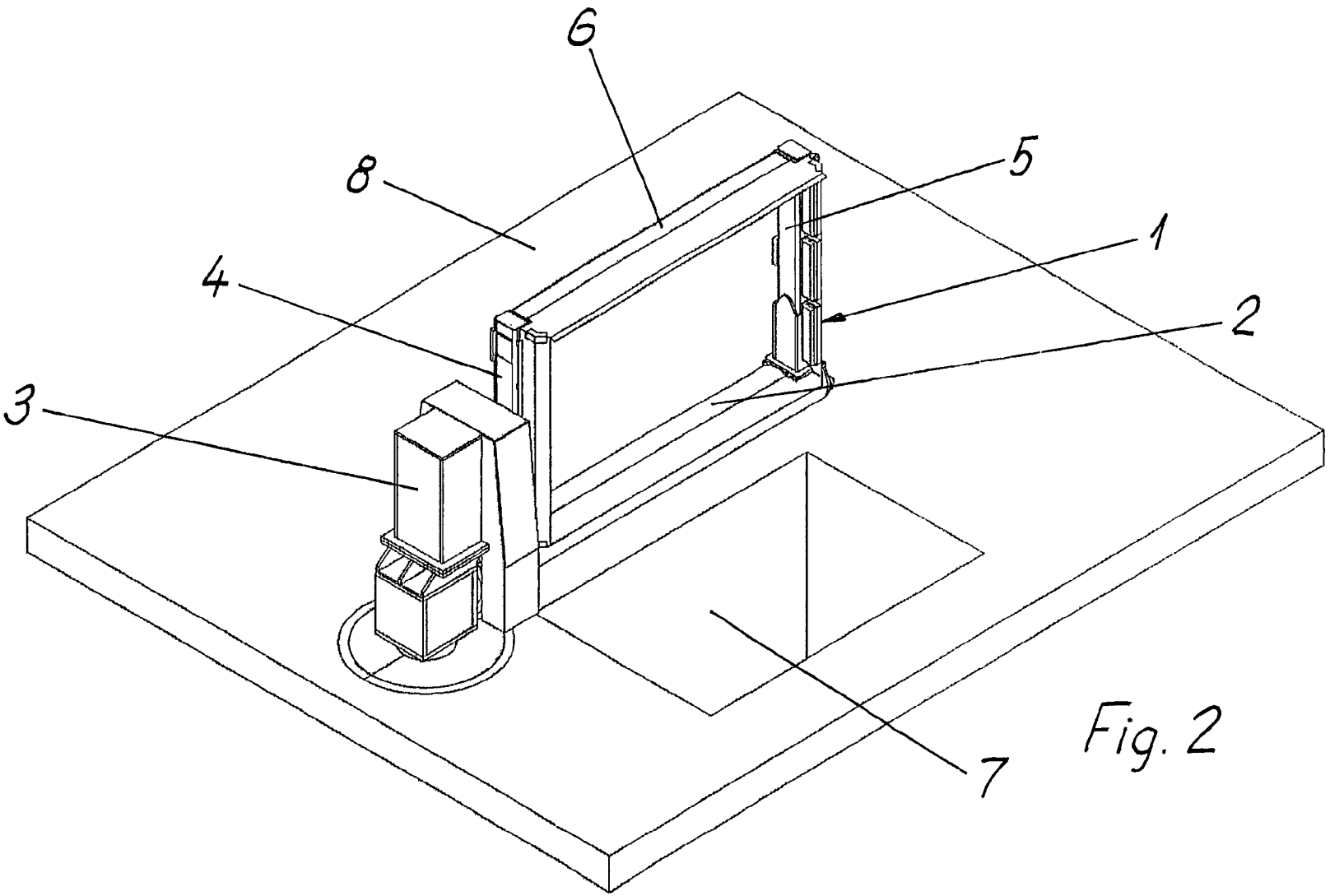
FIG. 2 shows the frame pivoted up to a vertical position. The pit is accessible for lifting out cast bolts or ingots.

FIG. 2 shows the frame 1 pivoted to a vertical position by rotation of the cantilever arm 2 relatively to the support 3. Thus, access to the pit is free from three sides.

Figure 3:
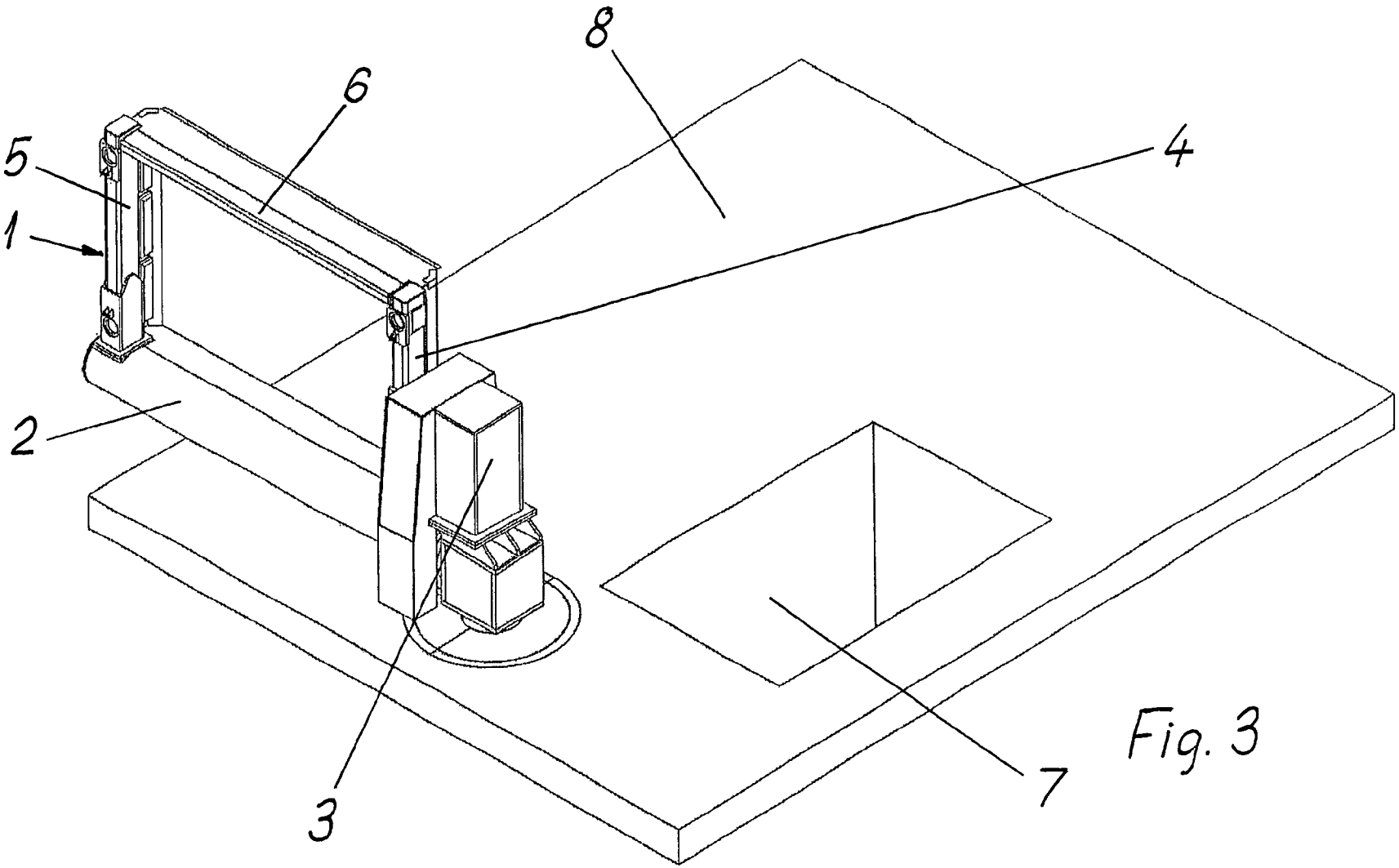
FIG. 3 shows the frame pivoted 90 degrees counterclockwise from the position shown in FIG. 2, ready for maintenance of molds.

FIG. 3 shows the frame 1 pivoted 90 degrees in the horisontal plane from the position shown in FIG. 2, together with the support 3. Thus, access to the pit 7 is free from all sides.

Figure 4:
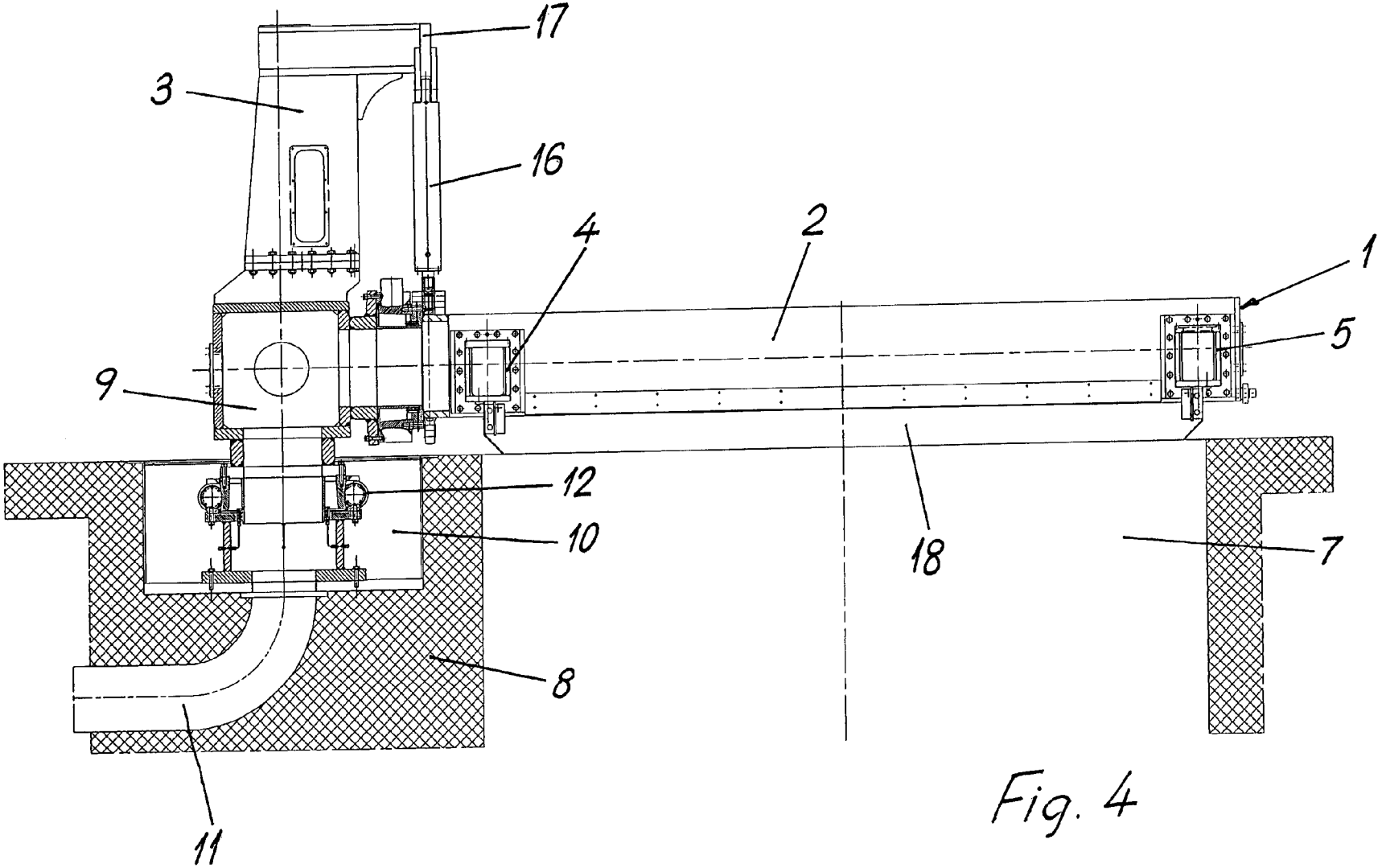
FIG. 4 shows in an elevational view and partly in a vertical section the structure of a support and a frame.
Figure 5:
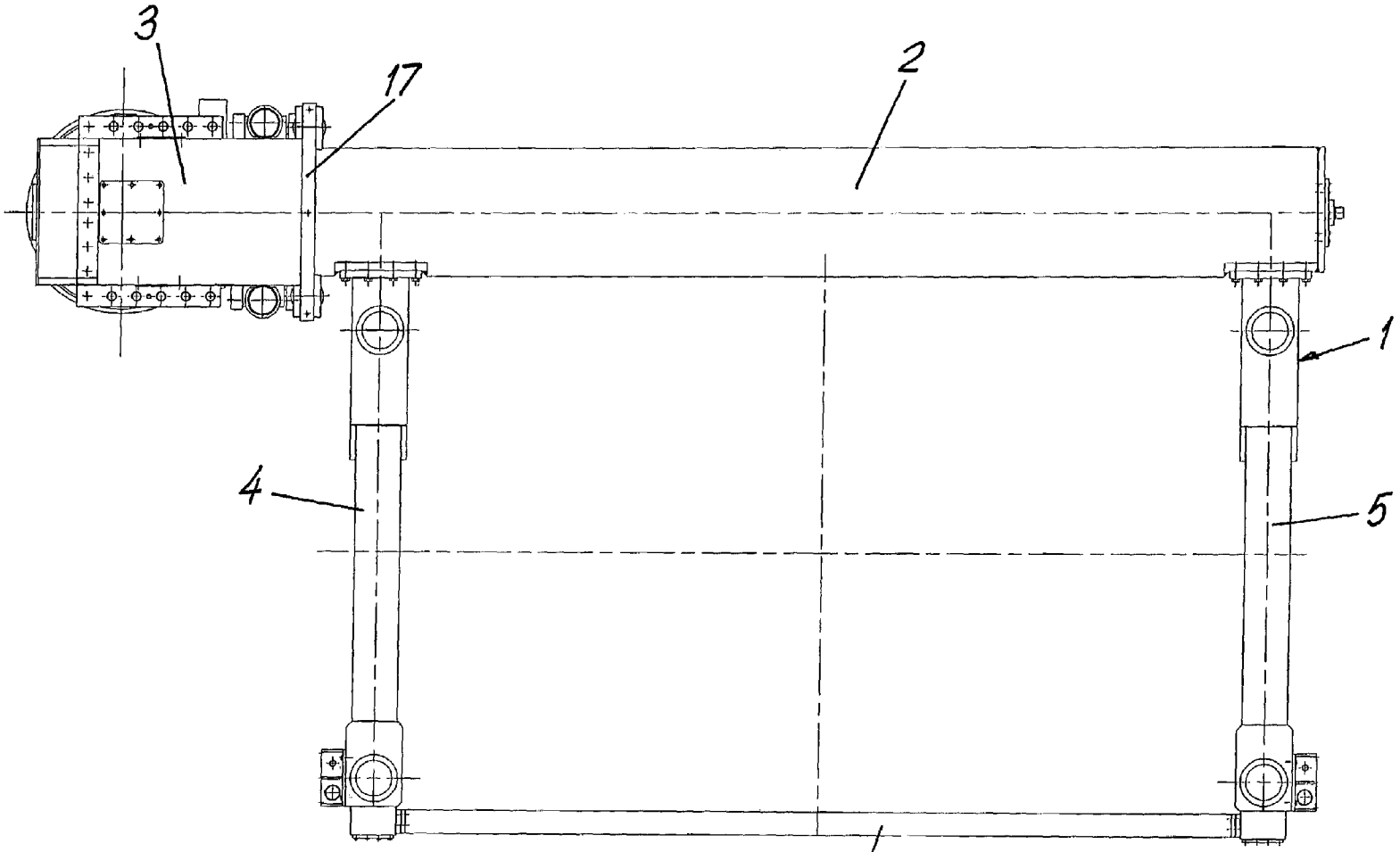
FIG. 5 shows the support and the frame seen from above.
Figure 6:
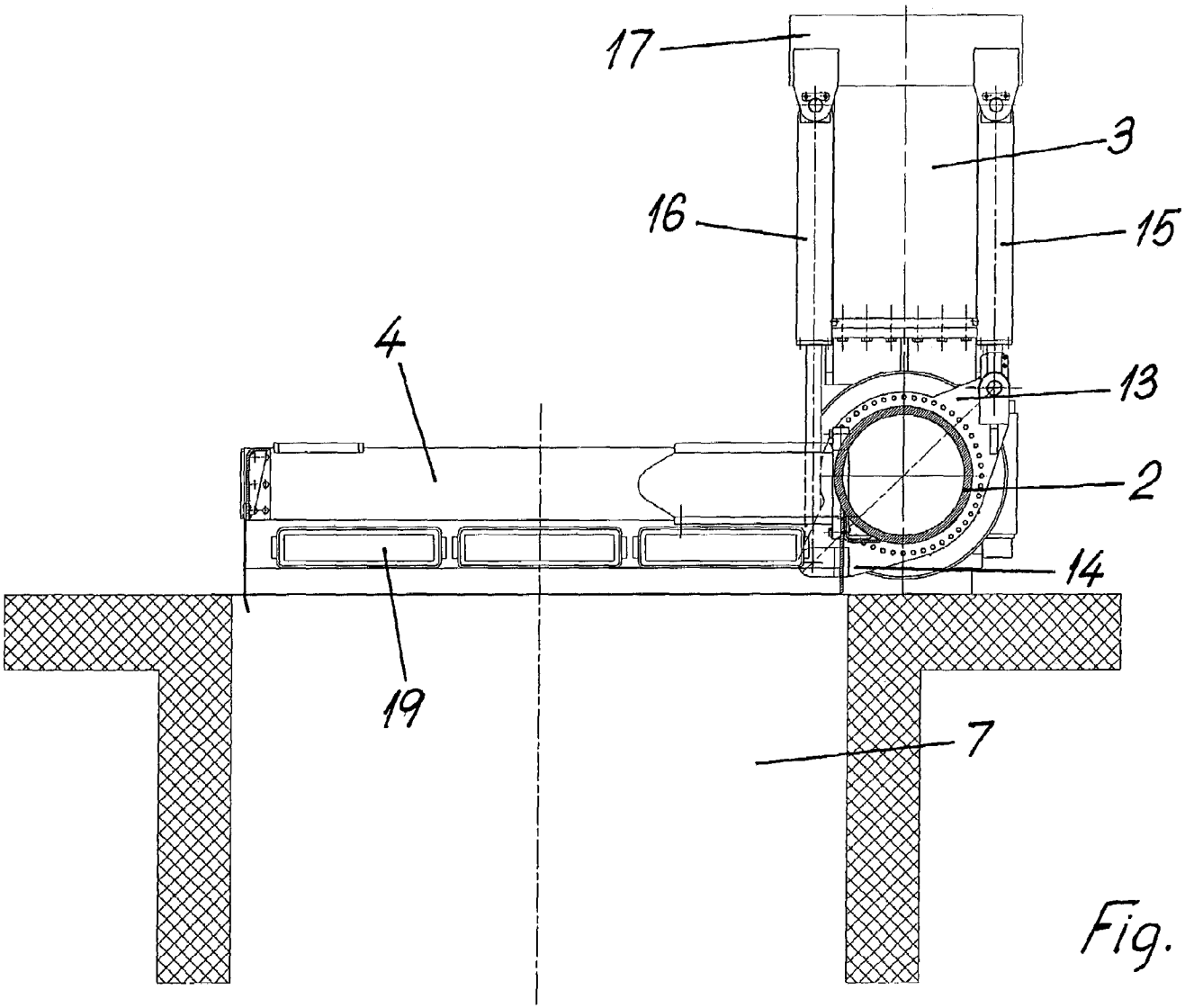
FIG. 6 shows the support and the frame in an elevational view, seen in a 90 degrees angle relatively to FIG. 4, wherein the cantilever arm is shown in a cross section.
Figure 7:
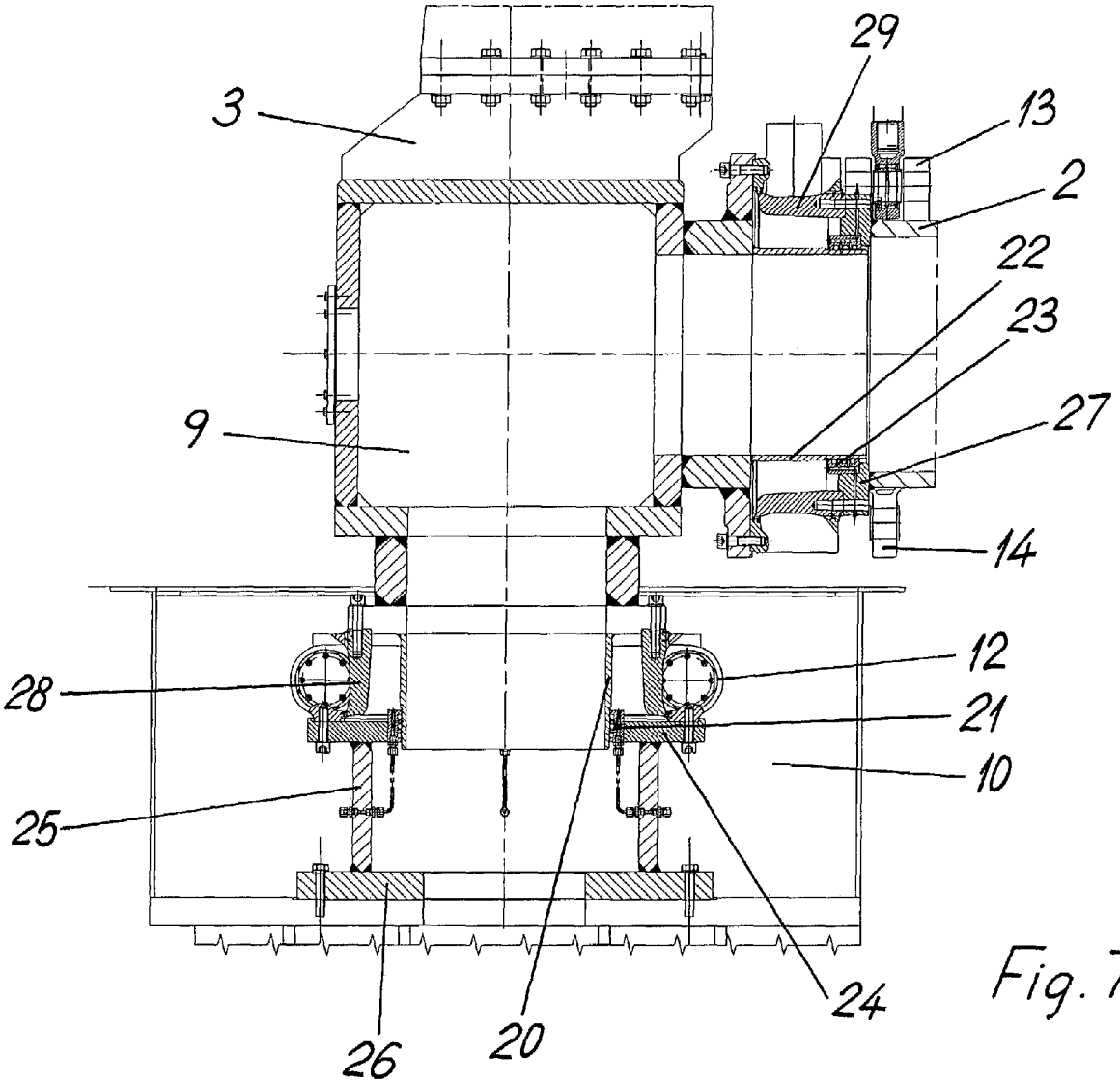
FIG. 7 shows in an elevational view and partly in a vertical section the structure of components of the support, correspondingly as shown in FIG. 4, but in a larger scale.

FIGS. 4, 5 and 6 show a possible structure of a frame and a support. FIG. 7 shows in a larger scale details of the support. The Figs. show how the support 3 is journalled for rotation in the base 8 and how the cantilever arm 2 is journalled in the support 3 for rotation. FIG. 4 shows how cooling water can be supplied through the support 3, by flowing up through the bearing for the support 3, through a chamber 9 in the support 3 and through the bearing for the cantilever arm 2. The cooling water flows inside the cantilever arm 2 and out of the arm through the frame sides 4 and 5, in order to be distributed to the molds (not shown) situated on the frame 1. FIG. 5 shows how the cantilever arm 2 holds the frame sides 4 and 5, which in turn hold the frame side 6. FIG. 4 shows a skirt 18 fastened lowermost on the cantilever arm 2. Corresponding skirts may be fastened to the frame sides 4, 5 and 6. The purpose is to prevent spill of water outside of the frame 1. FIG. 6 shows light fittings 19 fastened to the frame side 4. Corresponding light fittings may be fastened to the frame sides 5 and 6 and to the cantilever arm 2.

As shown in FIGS. 4 and 6, the support 3 is mounted in a recess 10 in the base 8. A water conduit 11 extends through the base 8 and up to the bearings for the support 3. As shown in FIG. 4, the bearings comprise a swivel 12, which may be in the form of a worm gear to be rotated by a (not shown) worm.

The mechanism for journalling and rotating the cantilever arm 2 relatively to the support 3 comprises a disc having two levers 13 and 14 protruding in diametrically opposite directions. These levers are each connected to a respective cylinder 15 and 16, and the cylinders are journalled in a yoke 17 at the top of the support 3. During rotation of the cantilever arm 2, and hence the entire frame 1, relatively to the support 3, the cylinders 15 and 16 exert oppositely directed forces, whereby they together exert a torque on the cantilever arm 2. This is an advantage, due to the large moment caused by the frame 1 and the molds, in particular during the initial phase of pivoting the frame upwardly.

As shown in FIG. 7, showing the lower portion of the support 3, the stationary part of the bearing 12 for the support is fastened to a disc 24 carried by a pipe socket 25 and a disc 26 resting on the base 8, in the recess 10 shown in FIG. 4. To the rotatable portion of the support 3 is fastened a sleeve 20, which extends downwardly into an aperture in the disc 24 and is in contact with a sealing ring 21 carried by the disc 24. A bearing ring 28 transfers the weight of the movable portions of the support 3 and the frame to the movable portion of the bearing.

Close to the cantilever arm 2, of which FIG. 7 only shows a short piece, is a disc 27 carrying a sealing ring 23. The sealing ring 23 is in contact with a sleeve 22 carried by the support 3. The cantilever arm 2 is fastened to the disc 27, which is fastened to a bearing ring 29. During use cooling water flows upwardly through the disc 26 and the sleeve 20, into the chamber 9 in the support 3, through the sleeve 22 and into the cantilever arm 2. FIG. 7 also shows the levers 13 and 14 for pivoting the frame 1 by use of the cylinders 15 and 16 shown in FIGS. 4 and 6.

The invention claimed is:

1. A machine for vertical casting of metal, comprising a frame on which casting molds can be mounted and through which cooling water can be supplied during casting, wherein said frame comprises a horisontal cantilever arm protruding from a support and being journalled in the support with one end, for vertical pivoting of the frame, said support being rotatable about a vertical axis for horisontal pivoting of the frame.

2. A machine according to claim 1, in which the cantilever arm, for being pivoted vertically, is connected to two levers protruding in diametrically opposite directions from the arm and being coupled to a respective cylinder connected to the support.

3. A machine according to claim 1, in which the support contains a chamber for supply of water from below, through bearings for the support and into the cantilever arm.

4. A machine according to claim 2, in which the support contains a chamber for supply of water from below, through bearings for the support and into the cantilever arm.

* * * * *